US009271900B2

(12) United States Patent
Badger et al.

(10) Patent No.: US 9,271,900 B2
(45) Date of Patent: Mar. 1, 2016

(54) HYGENIC PACIFIER APPARATUS AND METHOD

(71) Applicants: Janna Badger, Oakland, CA (US); Beau Oyler, Oakland, CA (US); Jared Aller, Oakland, CA (US)

(72) Inventors: Janna Badger, Oakland, CA (US); Beau Oyler, Oakland, CA (US); Jared Aller, Oakland, CA (US)

( * ) Notice: Subject to any disclaimer, the term of this patent is extended or adjusted under 35 U.S.C. 154(b) by 187 days.

(21) Appl. No.: 13/956,232

(22) Filed: Jul. 31, 2013

(65) Prior Publication Data

US 2014/0039553 A1 Feb. 6, 2014

Related U.S. Application Data

(60) Provisional application No. 61/678,078, filed on Jul. 31, 2012.

(51) Int. Cl.
*A61J 17/00* (2006.01)
*A61J 11/00* (2006.01)

(52) U.S. Cl.
CPC ..... *A61J 17/00* (2013.01); *A61J 11/008* (2013.01); *A61J 17/008* (2015.05)

(58) Field of Classification Search
CPC ..... A61J 17/00; A61J 17/02; A61J 2017/008
USPC ..... 606/234–236
See application file for complete search history.

(56) References Cited

U.S. PATENT DOCUMENTS

| | | | | |
|---|---|---|---|---|
| 3,363,630 | A * | 1/1968 | Hines | A61J 17/00 606/234 |
| 2002/0087191 | A1* | 7/2002 | Huang | A61J 17/00 606/236 |
| 2009/0108009 | A1* | 4/2009 | Yeung | 220/737 |
| 2013/0331887 | A1* | 12/2013 | Subramanian | A61J 17/00 606/236 |

* cited by examiner

*Primary Examiner* — Katherine M Shi
(74) *Attorney, Agent, or Firm* — Excellere IP International; Anne Burkhart

(57) ABSTRACT

A hygienic pacifier is set forth. The pacifier includes a base section having a nipple extending therefrom. The base section has a cross-sectional thickness. A substantially spherical recoil shield section is integrally formed with the base section. The shield section forms a wall having a cross-sectional thickness that is thinner in cross section than the cross-sectional thickness of the base section. The wall has recoil properties due to the spherical geometry of the shied section. The wall forms a shield around the nipple when recoiled.

21 Claims, 6 Drawing Sheets

HYGENIC PACIFIER APPARATUS AND METHOD

This application claims priority from U.S. provisional application No. 61/678,078 filed Jul. 31, 2012, the entirety of which is incorporated herein by reference.

TECHNICAL FIELD

The present disclosure relates to a pacifier. More particularly, the disclosure relates to an apparatus and method for a hygienic pacifier.

BRIEF DESCRIPTION OF THE DRAWINGS

Throughout the various figures, like reference numbers refer to like elements.

DETAILED DESCRIPTION

Figure 1:
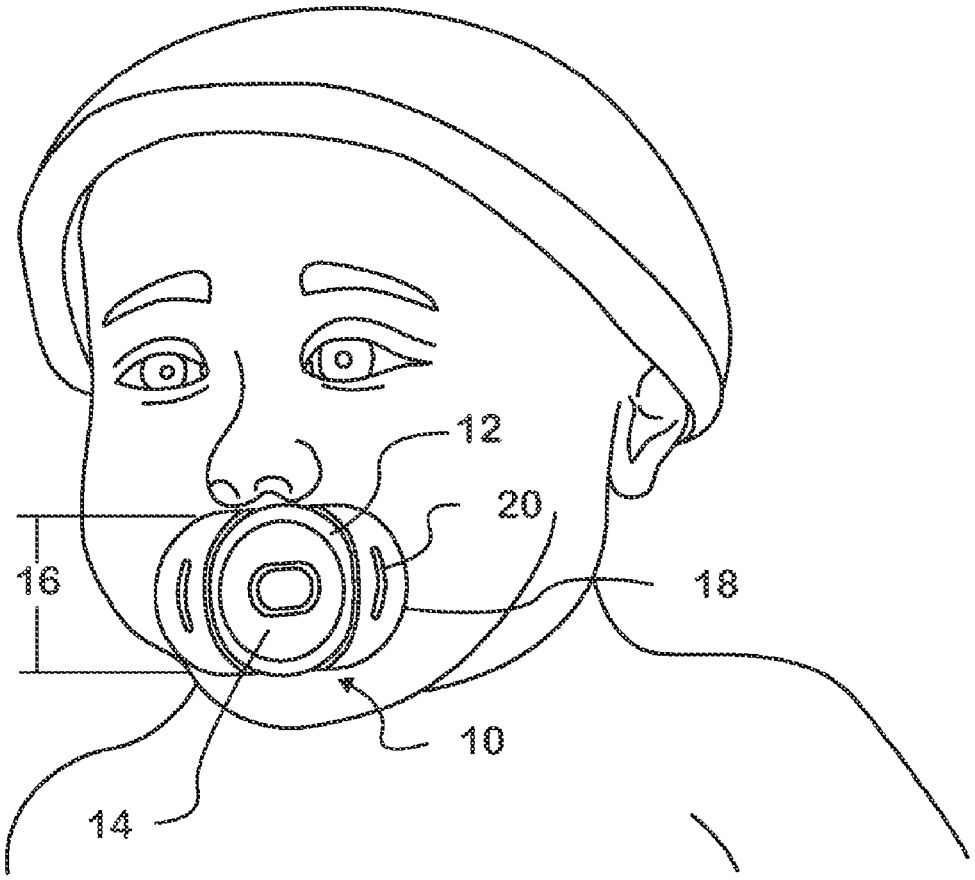
FIG. 1 is a perspective view of a hygienic pacifier in accordance with one embodiment of the present disclosure, including a shield having a wall shown as a substantially toroidal, or donut-shaped, element in a use position.
Figure 2:
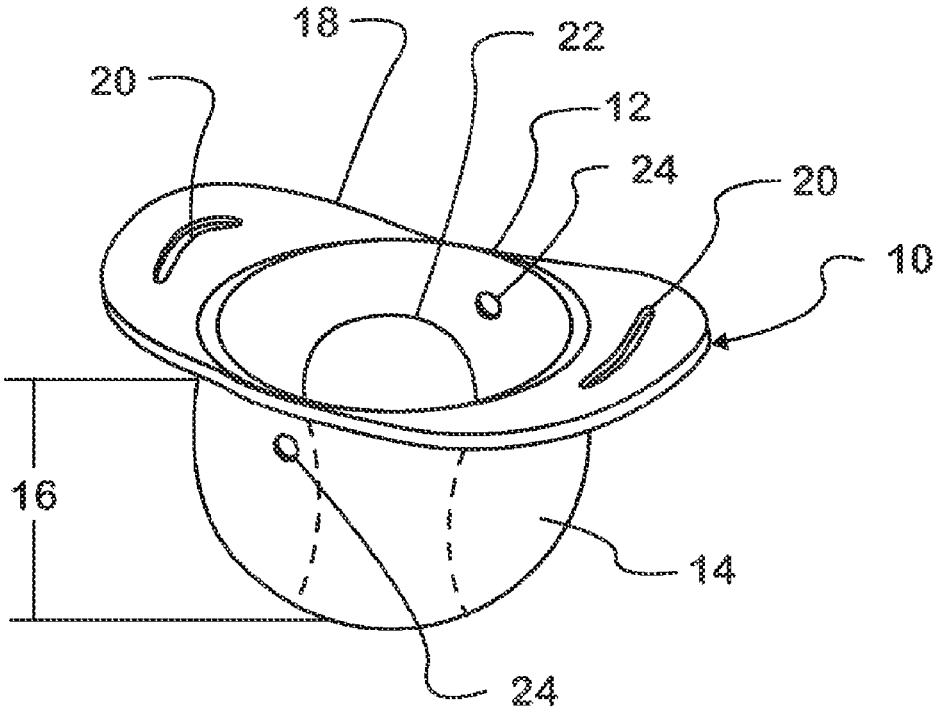
FIG. 2 is a perspective view of a hygienic pacifier with a shield having a wall in a recoiled, storage position.
Figure 3:
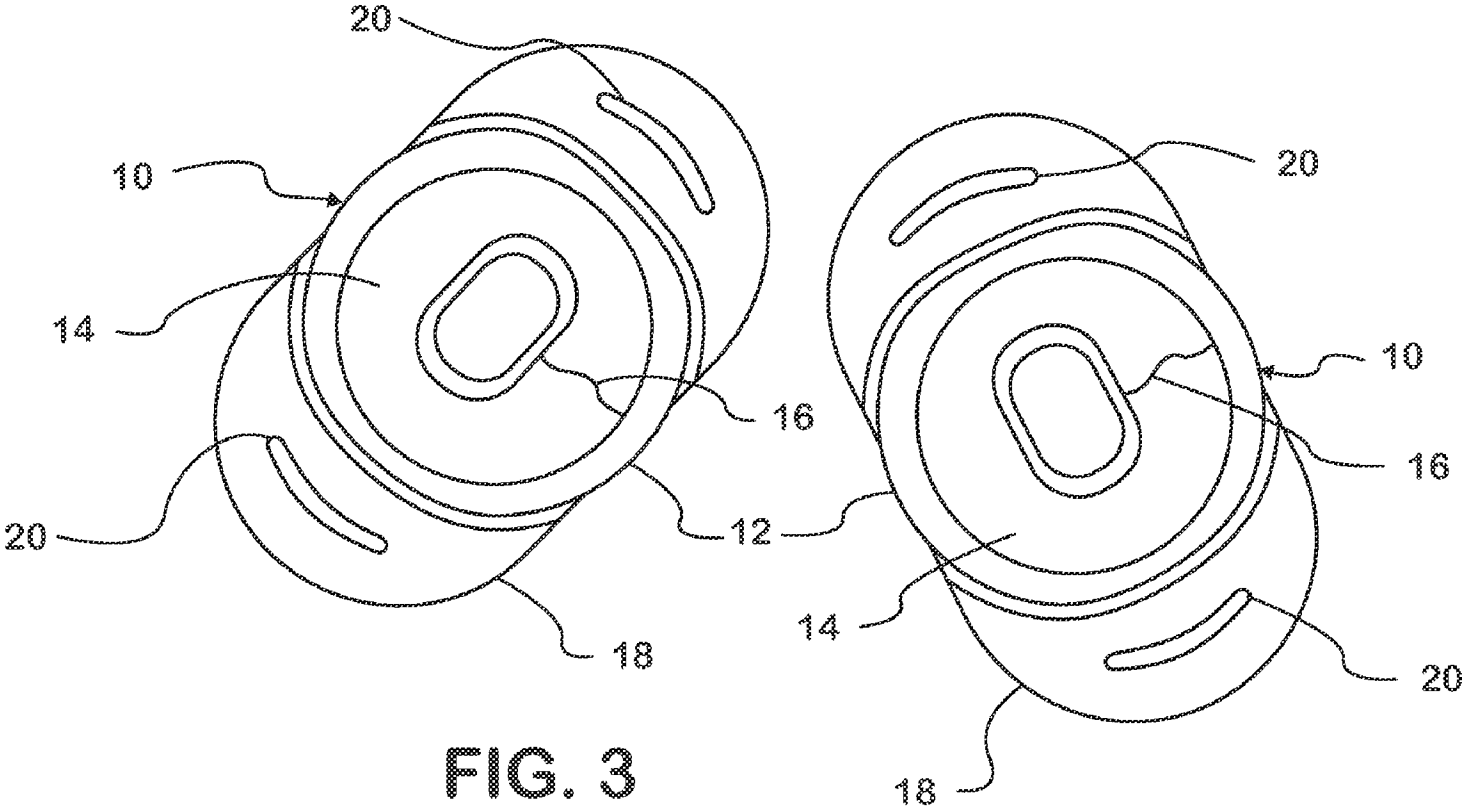
FIG. 3 is a top view of the hygienic pacifier of FIG. 2.

FIGS. 1-3 illustrate a hygienic pacifier 10, constructed in accordance with the principles herein. The pacifier 10 includes a base 12 and a shield 14. The shield 14 includes a substantially spherical wall 16, integrally formed with the base 12, yet having a thinner cross section than the base 12. A concave face plate 18 is integrally formed with the base plate 12, and can include slits 20 therein. As illustrated in FIG. 2, a nipple 22 is integrally formed with the shield 14. The distance between the nipple 22 and the 14 can be varied, in accordance with the principles herein. Further, suitable saliva exits, such as, for example, apertures 24 illustrated in FIG. 2, can be provided.

Figure 4A:
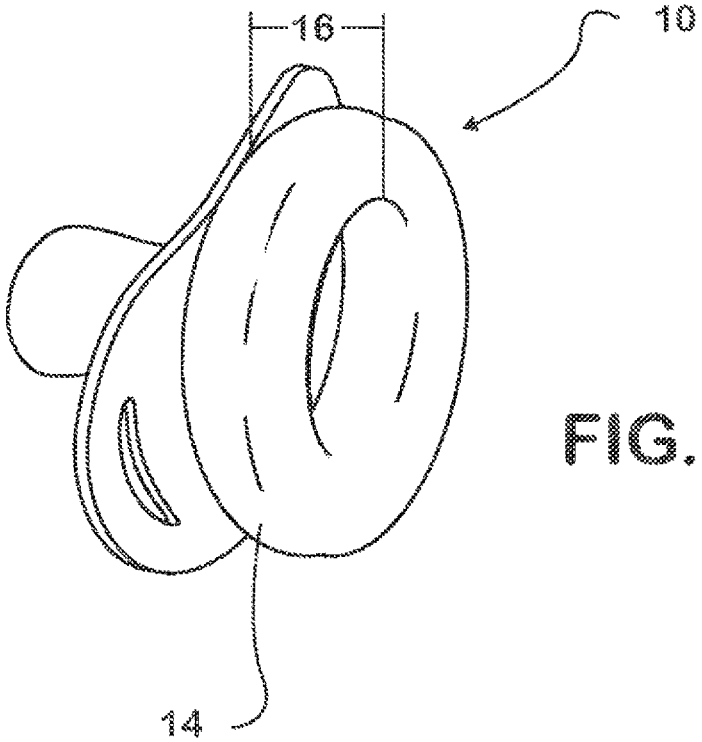
FIGS. 4A and 4B are a perspective views the hygienic pacifier of FIGS. 1 and 2, respectively.
Figure 4B:
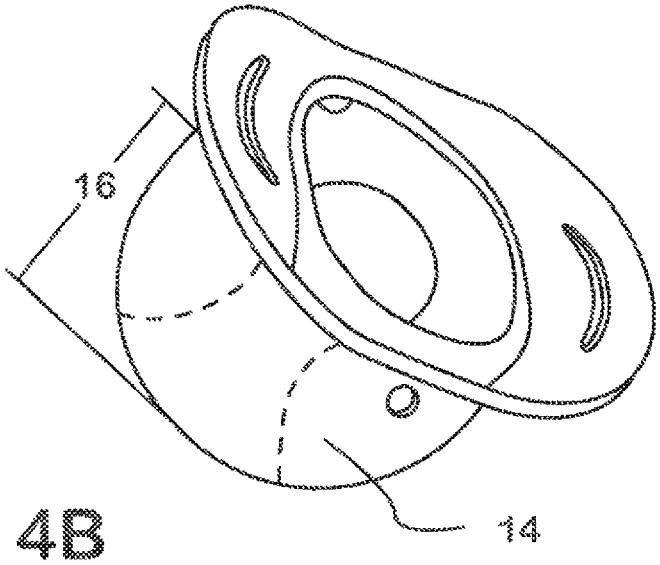

FIGS. 4A and 4B illustrate perspective views of the hygienic pacifier 10 of FIGS. 1 and 2, respectively. When the hygienic pacifier 10 is in a use position, a wall 16 of the shield 14 is in a substantially toroidal position, as illustrated, for example, in FIG. 4A. When the hygienic pacifier 10 is in a storage position, a wall 16 of the shield 14 is in a substantially spherical position, as illustrated, for example, in FIG. 4B. The shield is configured to invert and flip inside out from its storage position as shown in FIG. 4B to its use position as shown in FIG. 4A.

Figure 5:
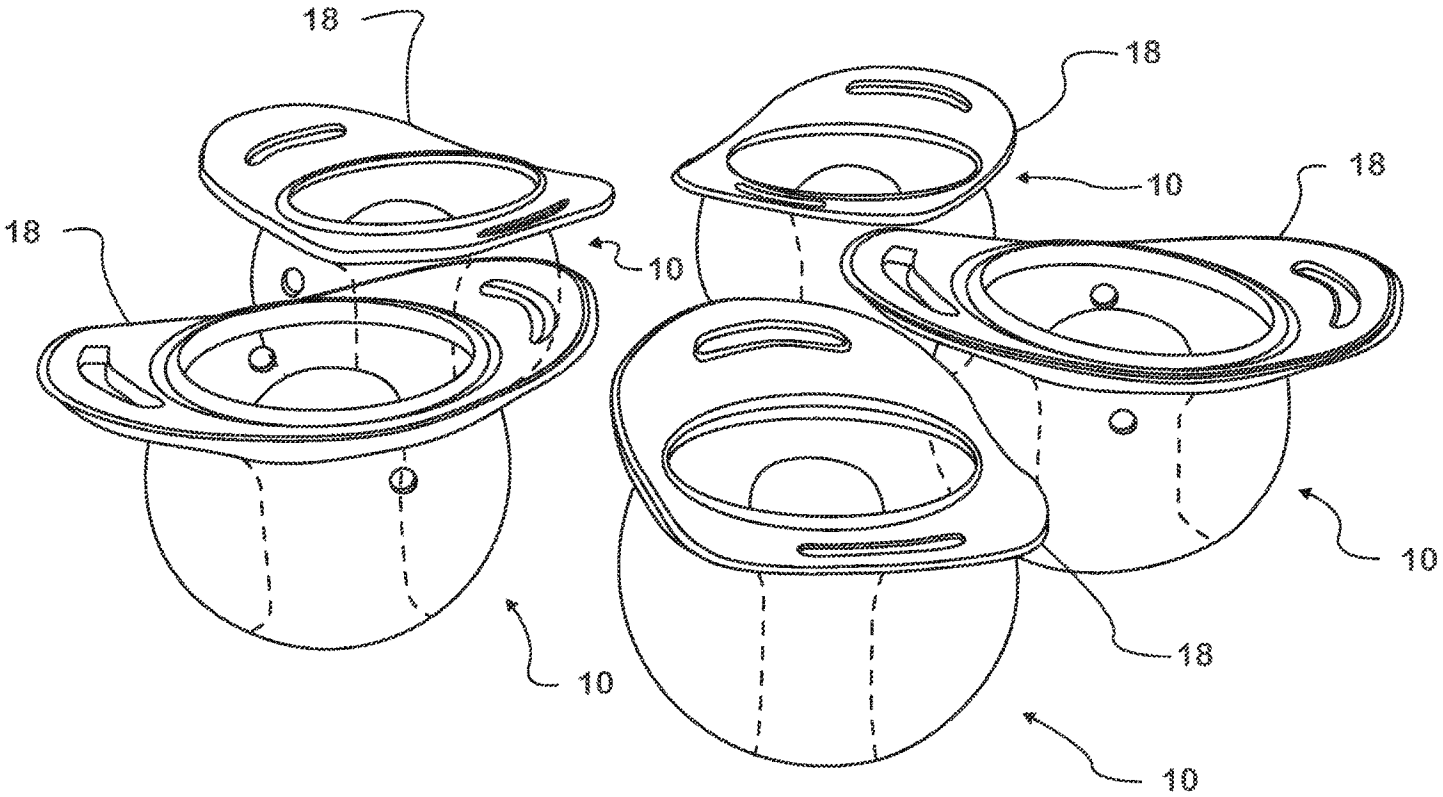
FIG. 5 illustrates various perspective views of hygienic pacifiers constructed in accordance with the principles herein.

FIG. 5 illustrates perspective views demonstrating the concavity a faceplate 18 of the hygienic pacifier 10 from various angles. It is also contemplated that a suitable material can include any suitable hygienic, flexible material for forming a pacifier.

Figure 6:
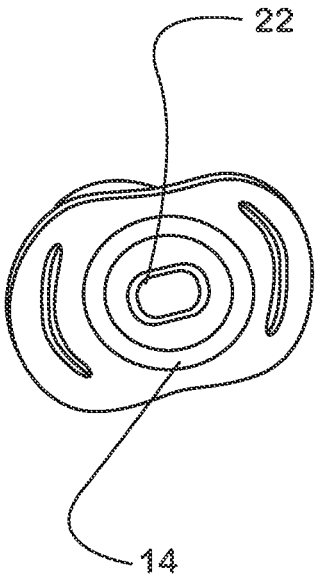
FIG. 6 illustrates embodiments of a hygienic pacifier constructed in accordance with the principles herein.
Figure 7:
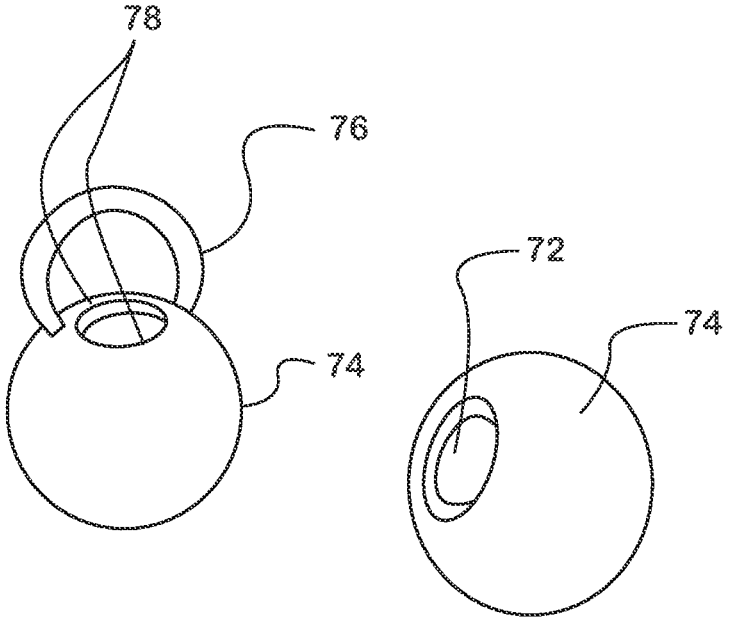
FIG. 7 illustrates an alternative embodiment of a hygienic pacifier constructed in accordance with the principles herein.

FIG. 6 illustrates additional embodiments of a hygienic pacifier 10 constructed in accordance with the principles herein. For example, FIG. 6 illustrates embodiments where the distance between a shield 14 and a nipple 22 is greater than the distance between a shield 74 and a nipple 72 shown in FIG. 7. Additionally, a hygienic pacifier constructed in accordance with the principles herein can include a handle 76, as shown, for example, in FIG. 7. Further, saliva slits 78 can be provided, shown near the handle 76 in FIG. 7, although the placement of the saliva slits 78 has been found to reduce the suction of the device in devices constructed in accordance with the principles herein employing medical grade silicone material to form the hygienic pacifier. Further, a ridge (not shown) can be provided around the base of the nipple to lock the pacifier into a use position.

Although any suitable method can be used in forming the hygienic pacifier, particular advantage can be achieved when the pacifier is formed via an injection molding process. A method in accordance with the principles herein includes the steps of forming a unitary, hygienic pacifier using a suitable material to provide a shield capable of recoiling from an in use toroidal position, to a spherical storage position. To this end, a suitable material, such as, for example, medical grade silicone, can be formed by a suitable process, such as by injection molding, to form a unitary device including a shield having a wall. The wall of the shield is formed by the process to enable sufficient recoil of the device from a use position to a storage position, without rendering the device too springy to function in the use position. To this end, various suitable materials can be manipulated to produce recoil properties to ensure functionality of the device. Advantageously, flexible spheres that can automatically retract the nipple of the pacifier due to the varied thickness and resiliency of the material of the unitary device are achieved in accordance with the principles herein. The design eliminates the need to apply external forces to retract the nipple to achieve a storage position. Additionally, the shape of a device constructed in accordance with the principles herein is ergonomic, making the structure easier to use for children with limited movement.

For example, a typical wall thickness for medical grade silicone is in the range of 1.5 to 2 mm. In accordance with the principles herein, the base and nipple of the device are formed at the typical thickness, whereas the shield wall can be reduced down to approximately 0.7 to 1 or 1.5 mm thickness, and the thickness can vary across the structure by increasing in thickness as the material transitions to the end of the sphere nearest the faceplate. Further, the thickness of the faceplate can range from 2 mm up to approximately 7 mm. It will be understood to those of skill in the art that the relative reduction in thickness may need to be adjusted depending on the recoil characteristics of various materials.

For each material considered, a balance between obtaining the thickest wall possible while retaining the recoil functionality of the device must be considered. Further, the distance between the nipple and the shield wall can be adjusted to vary the suction characteristics of the device. In additional steps, a lanyard may be attached to slits or holes provided in the device. Colorant may also be added to the material while forming the device. The device can be textured on the exterior to prevent artifacts, such as lint, from adhering to the silicone surface. Further, the spherical shape of the shield eliminates crevices in known devices that can house dirt or debris. While the embodiments disclosed herein are exemplary, various changes and modifications can be made without departing from the spirit and scope of the present disclosure.

We claim:

1. A hygienic pacifier comprising:

a base section having a nipple extending therefrom; and a shield section, integrally formed with the base section, the shield section being movable between a use position in which the shield section is substantially toroidal and the nipple is exposed for use, and a storage position in which the shield is substantially spherical and surrounds the nipple, wherein the shield is configured to invert from the storage position and flip inside out to the use position.

2. A hygienic pacifier in accordance with claim 1, further comprising a handle secured to the shield section.

3. A hygienic pacifier in accordance with claim 1, further comprising at least one saliva exit formed in the base section.

4. A hygienic pacifier in accordance with claim 1, wherein the pacifier is formed from a hygienic, flexible material.

5. A hygienic pacifier in accordance with claim 4, wherein the hygienic, flexible material comprises medical grade silicone.

6. A hygienic pacifier in accordance with claim 4, wherein the hygienic, flexible material comprises a material containing a colorant.

7. A hygienic pacifier in accordance with claim 1, wherein the base section has a thickness in a range from approximately 1.5 to 2 mm.

8. A hygienic pacifier in accordance with claim 7, wherein the shield section has a thickness in a range from approximately 0.7 to 1 or 1.5 mm.

9. A hygienic pacifier in accordance with claim 1, wherein the shield section has a varying thickness.

10. A hygienic pacifier in accordance with claim 9, wherein the shield section thickness increases in thickness as the material transitions to the end of the sphere nearest the faceplate.

11. A method of forming a hygienic pacifier, the method comprising the following steps:

forming a base section;

forming a nipple extending from the base section; and forming a shield section integrally with the base section, the shield section being movable between a use position in which the shield section is substantially toroidal and the nipple is exposed for use, and a storage position in which the shield is substantially spherical and surrounds the nipple, wherein the shield is configured to invert from the storage position and flip inside out to the use position.

12. A method in accordance with claim 11, further comprising the step of forming a handle secured to the shield section.

13. A method in accordance with claim 11, further comprising the step of forming at least one saliva exit in the base section.

14. A method in accordance with claim 11, further comprising the step of forming the pacifier from a hygienic, flexible material.

15. A method in accordance with claim 14, wherein the step of forming the pacifier from a hygienic, flexible material comprises forming the pacifier from medical grade silicone.

16. A method in accordance with claim 14, wherein the step of forming the pacifier from a hygienic, flexible material comprises forming the pacifier from a material containing a colorant.

17. A method in accordance with claim 11, further comprising the step of forming the base section to have a thickness in a range from approximately 1.5 to 2 mm.

18. A method in accordance with claim 17, further comprising the step of forming the shield section to have a thickness in a range from approximately 0.7 to 1 or 1.5 mm.

19. A method in accordance with claim 11, further comprising the step of forming the shield section to have a varying thickness.

20. A method in accordance with claim 19, further comprising the step of forming the shield section to have a thickness that increases in thickness as the material transitions to the end of the sphere nearest the faceplate.

21. A hygienic pacifier comprising:

a base section having a nipple extending therefrom, the base section having a thickness; and a shield section, integrally formed with the base section and having a thickness that is less than the thickness of the base section; whereby the shield section being movable between a use position in which the shield section is substantially toroidal and the nipple is exposed for use, and a storage position in which the shield is substantially spherical and surrounds the nipple, wherein the shield is configured to invert from the storage position and flip inside out to the use position.

* * * * *